US008013541B2

(12) United States Patent
Primiano

(10) Patent No.: US 8,013,541 B2
(45) Date of Patent: Sep. 6, 2011

(54) LED LIGHT OUTPUT LINEARIZATION

(75) Inventor: Guy A. Primiano, Atlanta, GA (US)

(73) Assignee: The Coca-Cola Company, Atlanta, GA (US)

( * ) Notice: Subject to any disclaimer, the term of this patent is extended or adjusted under 35 U.S.C. 154(b) by 55 days.

(21) Appl. No.: 12/533,490

(22) Filed: Jul. 31, 2009

(65) Prior Publication Data

US 2009/0289576 A1 Nov. 26, 2009

Related U.S. Application Data

(63) Continuation of application No. 11/937,551, filed on Nov. 9, 2007, now Pat. No. 7,586,274.

(51) Int. Cl.
*G05F 1/00* (2006.01)

(52) U.S. Cl. ..... 315/291; 315/360; 315/307

(58) Field of Classification Search ..... 315/360, 315/246, 247, 185 R, 185 S, 291, 294, 307
See application file for complete search history.

(56) References Cited

U.S. PATENT DOCUMENTS

| | | | |
|---|---|---|---|
| 1,607,922 | A | 11/1926 | Schweitzer |
| 2,163,562 | A | 6/1939 | Putnam |
| 2,336,416 | A | 12/1943 | Parker |
| 4,941,072 | A | 7/1990 | Yasumoto |
| 5,420,712 | A | 5/1995 | Maeda |
| 5,459,337 | A | 10/1995 | Ito |
| 5,583,349 | A | 12/1996 | Norman |
| 5,612,811 | A | 3/1997 | Aikawa |
| 5,757,181 | A | 5/1998 | Wolf |
| 5,836,676 | A | 11/1998 | Ando |
| 5,851,063 | A | 12/1998 | Doughty |
| 5,980,063 | A | 11/1999 | Ford |
| 5,982,957 | A | 11/1999 | DeCaro |
| 6,283,612 | B1 | 9/2001 | Hunter |
| 6,346,777 | B1 | 2/2002 | Kim |
| 6,379,022 | B1 | 4/2002 | Amerson |
| 6,406,108 | B1 | 6/2002 | Upton |

(Continued)

FOREIGN PATENT DOCUMENTS

| | | |
|---|---|---|
| DE | 10345779 | 4/2005 |

(Continued)

OTHER PUBLICATIONS

Disclosure Statement Under 37 C.F.R. § 1.56 for U.S. Appl. No. 12/533,490.

*Primary Examiner* — Douglas W Owens
*Assistant Examiner* — Jianzi Chen
(74) *Attorney, Agent, or Firm* — Sutherland Asbill & Brennan LLP

(57) ABSTRACT

A system and method for producing a flattened characteristic for LED luminous output. The system may include an array containing one or more light emitted diodes, a power source connected to the LED array providing drive current to the LED array, a timer connected to a controller wherein the timer logs the on-time of the LED array and communicates the LED array on-time to the controller, and a controller connected to the power source wherein the controller adjusts the intensity of the drive current provided to the LED array based on the on-time data received from the timer such that the resultant relative luminous output is approximately equal to the initial relative luminous output.

11 Claims, 3 Drawing Sheets

U.S. PATENT DOCUMENTS

| | | | |
|---|---|---|---|
| 6,411,046 | B1 | 6/2002 | Muthu |
| 6,672,552 | B1 | 1/2004 | Jao |
| 6,979,104 | B2 | 12/2005 | Brass |
| 7,114,841 | B2 | 10/2006 | Aanegola |
| 7,324,130 | B2 | 1/2008 | Russell |
| 2003/0007346 | A1 | 1/2003 | Cooper |
| 2003/0123254 | A1 | 7/2003 | Brass |
| 2003/0198049 | A1 | 10/2003 | Hulse |
| 2004/0062031 | A1 | 4/2004 | Pinter |
| 2004/0070965 | A1 | 4/2004 | Lin |
| 2004/0095741 | A1 | 5/2004 | Chen |
| 2004/0105264 | A1 | 6/2004 | Spero |
| 2004/1056182 | | 8/2004 | Hatjasalo |
| 2004/0174706 | A1 | 9/2004 | Kan |
| 2005/0007754 | A1 | 1/2005 | Creel |
| 2005/0112801 | A1* | 5/2005 | Russell et al. ..... 438/116 |
| 2005/0286265 | A1 | 12/2005 | Zampini |
| 2006/0028843 | A1 | 2/2006 | Parker |
| 2006/0033114 | A1 | 2/2006 | Schranz |
| 2006/0077686 | A1 | 4/2006 | Han |
| 2006/0221632 | A1 | 10/2006 | Hsu |
| 2006/0249739 | A1 | 11/2006 | Wang |
| 2006/0262539 | A1 | 11/2006 | Goulet |
| 2006/0274554 | A1 | 12/2006 | Parker |

FOREIGN PATENT DOCUMENTS

| | | | |
|---|---|---|---|
| JP | 4106778 | | 4/1992 |
| JP | 2003307819 | | 10/2003 |
| JP | 2006172820 | A2 | 6/2006 |

* cited by examiner

LED LIGHT OUTPUT LINEARIZATION

CROSS REFERENCE TO RELATED APPLICATIONS

The present application is a continuation of co-pending U.S. application Ser. No. 11/937,551 filed Nov. 9, 2007, entitled "LED Light Output Linearization," which is incorporated by reference herein in its entirety.

TECHNICAL FIELD

The present application relates generally to LED lighting schemes and more particularly relates to linearizing the output of LED lights to produce a more consistent output over the life of an LED.

BACKGROUND OF THE INVENTION

Product dispensers may take many different shapes and sizes. Each dispenser generally requires some sort of product illumination and/or signage illumination. Due to the increased lifetime and decreased power usage, light emitting diode ("LED") lighting is becoming common in many lighting applications. Typical LEDs used for illumination in a product dispenser setting may range from 0.5 to 3 watts and 25 to 70 lumens per watt. Such LEDs may typically be rated to operate for 40,000 to 50,000 hours before failure. Unlike many light sources, where failure is defined as a point in time at which no output is being produced, LED failure is typically defined as a point in time where the luminous output is less than 70% of the original output of the LED.

While the failure mode in LEDs is more desirable than the failure mode of other light sources, a problem remains. For example, many product vending machines employ LEDs to illuminate product selections available for purchase. When a vending machine containing a "young" LED array is located next to a vending machine with an "aged" LED array (one that has not failed, but has degraded and produces less output than originally desired), the significant difference in luminous output is readily apparent to a potential consumer due to the light degradation that has occurred in the "aged" LED array.

A dimly lit dispenser or a dispenser with a degraded lighting source may give a consumer at least the perception that the products therein are not adequately maintained. Resultantly, potential consumers will tend to make a purchase from the vending machine with the "younger" LED array as the appearance is more visually appealing and catches the eye of the consumer. These LED issues generally need to be addressed in the context of adequate product marketing, i.e., the dispenser and the products therein should be properly illuminated so as to be visually appealing and catch the eye of the consumer.

There is a desire, therefore, for an improved LED powering scheme which maintains consistent luminous output for the rated life of the LED. This improved LED powering scheme should provide for uniform appearance of LEDs over their practical lifetime.

SUMMARY OF THE INVENTION

The present application thus describes a system for producing a flattened characteristic for LED luminous output. The system may include an array containing one or more light emitted diodes, a power source connected to the LED array providing drive current to the LED array, a timer connected to a controller wherein the timer logs the on-time of the LED array and communicates the LED array on-time to the controller, and a controller connected to the power source wherein the controller adjusts the intensity of the drive current provided to the LED array based on the on-time data received from the timer such that the resultant relative luminous output is approximately equal to the initial relative luminous output.

The array of LEDs may simply be any number of LEDs operating in conjunction with one another and powered by the same power source. Notably, an array may solely contain a single LED. Typical LEDs used for illumination in a product dispenser setting may range from 0.5 to 3 watts and 25 to 70 lumens per watt. Such LEDs may typically be rated to operate for 40,000 to 50,000 hours before failure. While the present application discusses LEDs typical in a product dispenser context, it should be recognized that this invention is operable with LEDs used in any context and is not limited to any particular embodiment.

The power source providing the drive current may be any suitable power source for providing power to an array of LEDs. In the preferred embodiment of the present invention, the power source may provide alternating current (AC) power from a pulse width modulation power supply. While the present application discusses the use of AC power, it should be recognized that this invention is operable with direct current (DC) power. The figures provided herein, however, are in the context of AC power. The power source provides a variable drive current to power the array of LEDs. A controller is used for controlling the intensity of the power source output according to preset instructions that correspond to the relative power output intensity with the LED array on-time indicated by a timer.

The timer connected to a controller may be any timer suitable for monitoring "on-time" of the array of LEDs. The controller may be programmed to trigger an adjustment of the drive current based on the current timed usage data communicated by the timer, to help ensure that the proper drive current intensity is supplied to maintain the luminous output of the array at a consistent level.

These and other features of the present application will become apparent to one of ordinary skill in the art upon review of the following detailed description when taken in conjunction with the appended claims and drawings.

DETAILED DESCRIPTION

The present invention now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
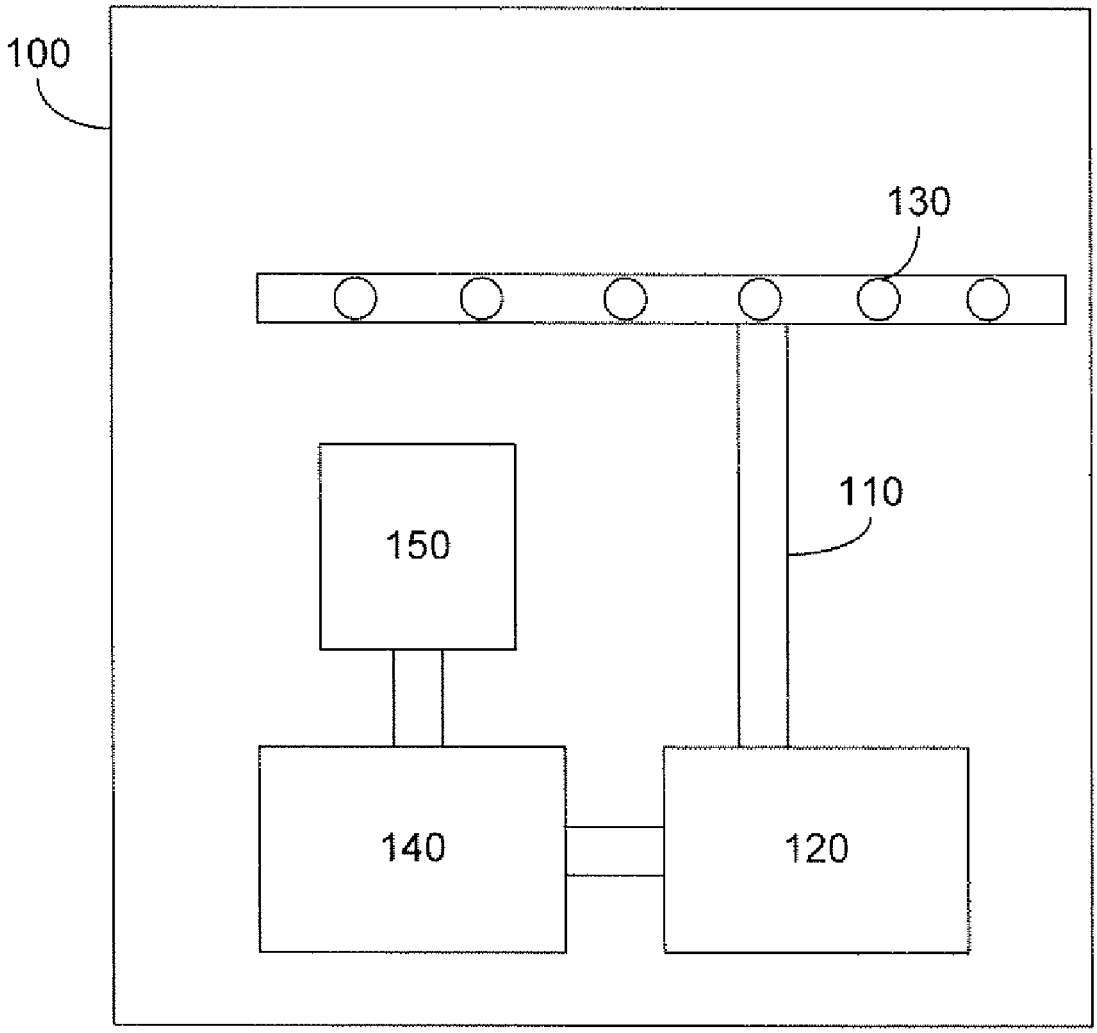
FIG. 1 is an illustration of one embodiment according to aspects of the present invention.

FIG. 1 shows an exemplary embodiment of the present invention employed in a product dispenser 100. The dispenser 100 is typical to dispensers used in the vending industry.

However, it should be noted that the present invention is not limited as such and may be used in any setting which requires consistent luminous output. Typically, the dispenser 100 includes at least one power bus 110. Any type of power source 120 may be used herein in accordance with the present invention. The power bus 110 may be in electrical communication from the power source 120 to one or more LEDs 130 via electrical wiring. The power bus 110 delivers the drive current required to illuminate the LEDs 130 at the desired intensity.

The power source 120 is capable of affecting the current, voltage and duty cycle to effectuate a different current intensity level. Typically, a single power source 120 may be sufficient to effectively power a number of LEDs 130.

If multiple LED's 130 are employed in an LED array 130, then they may be wired together and connected electronically to the power source 120. Again, it should be noted that while the embodiment discussed herein involves an LED array 130, it should be clear that the invention may be similarly employed with a single LED 130 as well. Furthermore, other forms of powering the LED array 130 also may be used in accordance with the present invention. For example, the power source 120 may either supply alternating current power supply voltage or direct current power supply voltage. Furthermore the power source 120 may be mounted on a flexible printed circuit board in certain embodiments.

Obviously, the LED array 130 can operate on either DC or pulsed power and current. In this embodiment, pulse width modulation is effected by the controller 140 to effect current intensity changes.

The timer 150 operates to log the operating time of the LED array 130. As the LED array 130 operating time lengthens, the controller 140 interacts with the power source 120 and operates to increase the relative power-source output to the level corresponding to the LED array 130 on-time amount received from the timer 150. The controller 140 uses stored algorithms as discussed below to determine the proper adjustment of relative power-source output in relation to the received on-time to result in the maintenance of a constant luminous output intensity. The controller 140 may be a computer board, embedded device, a digital signal processor, or any other appropriate controller device known to those skilled in the art.

In the preferred embodiment of the present invention, pulse width modulation is effected by the controller 140 to achieve the desired relative luminous output of the LED array 130. The timer 150 communicates the LED array 130 on-time to the controller 140. The controller 140 then calculates the required change (if any) to the relative power-source output to maintain a constant relative luminous output. To effectuate the change to the relative power source output, the controller 140 may operate to modulate the pulse widths of the incoming power current to result in either a longer or shorter LED on-time per cycle thus increasing or decreasing the relative luminous output accordingly.

Figure 2:
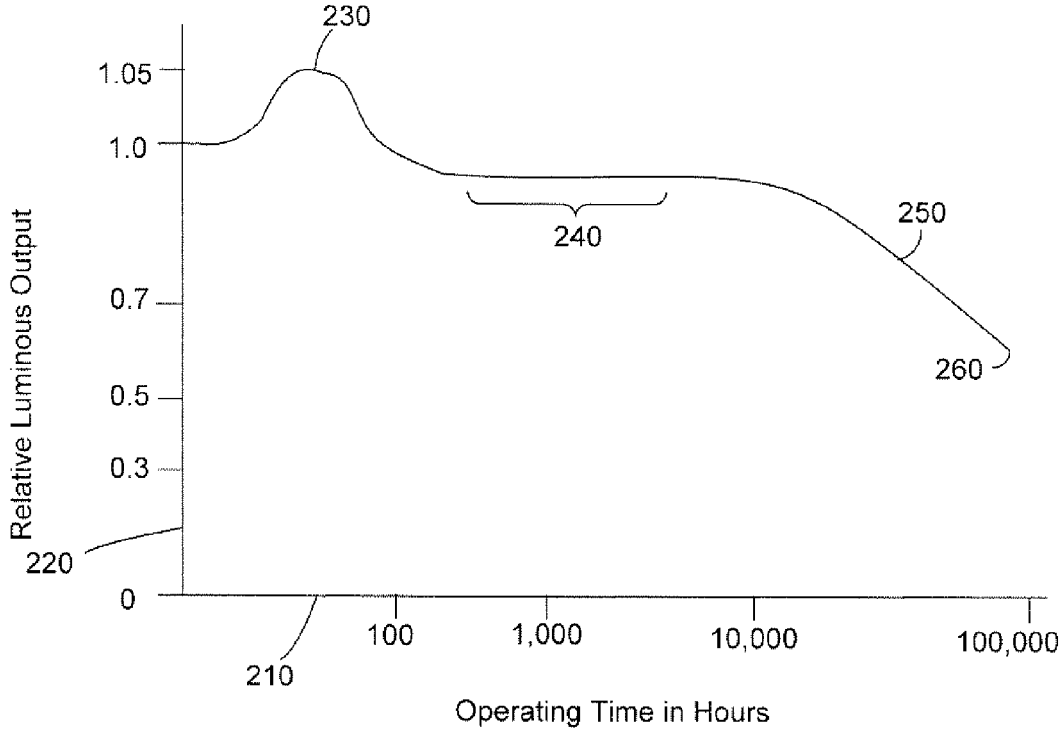
FIG. 2 is a graphical representation of the typical degradation of LED luminous output.

FIG. 2 illustrates the typical degradation of luminous output for an LED as typically used in a product container 100. The x-axis 210 represents operating time in hours of the LED 130 (or LED array 130). The y-axis 220 represents the relative luminous output of the LED 130. In the instant figure, the relative luminous output of an LED 130 when it first goes into operation is valued at 1.0. After an LED 130 has been in operation for an initial time period (typically less than 100 hours), it reaches a peak 230 of its lifetime luminous output. Typically this so called "burn-in" peak 230 reaches a relative luminous output level of about 1.05.

After the initial "burn-in" peak 230 is reached the relative luminous output decreases over time for the remainder of the LED's 130 lifetime. The luminous output degrades approximately as the logarithm of operating time. As can be seen in the segment labeled 240, from about 100 hours of operating time to about 2,000 hours of operating time, the relative luminous output is fairly constant.

Point 250 indicates the typical failure point of an LED 130. As pointed out above, an LED's 130 failure point is typically defined where its relative luminous output is less than 0.7 of its initial relative light output. A typical LED 130 reaches its failure point 250 after 40,000 to 50,000 hours of operation. Finally, point 260 illustrates the time at which a typical LED 130 reaches a point where the LED's relative luminous output reaches less than 0.5 of its initial relative luminous output. This commonly occurs after about 100,000 hours of operation.

Similarly, operating temperature may be taken in effect when evaluating the degradation pattern of the LED 130. Typically, a loss of approximately one percent (1%) of intensity with every one degree Centigrade increase in temperature is observed in certain commercially available LEDs. It should be recognized that this is a general guideline and is not meant to restrict application of the present invention in any way.

Figure 3:
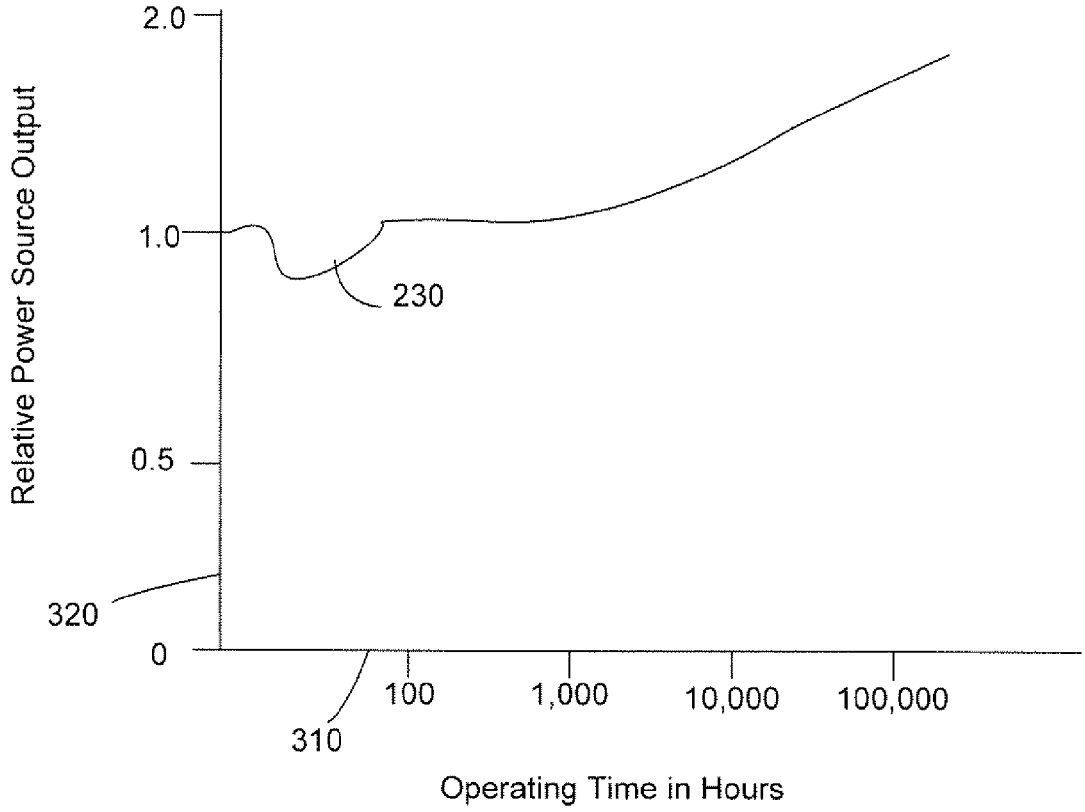
FIG. 3 is a graphical representation of the relative power output required according to aspects of the present invention.

FIG. 3 illustrates the required power-source output used to power the LED 130 in a fashion to create a flattened relative luminous output over the typical lifetime for an LED 130. The x-axis 310 represents operating time in hours of the LED 130 (or LED array). The y-axis 320 represents the relative power-source output of the power source 120. In the instant figure, the relative power-source output when an LED 130 first goes into operation is valued at 1.0. The level of relative power-source output required at any given point in time may be calculated by a simple formula: [2.0—relative light output]. Thus, at "burn-in" peak 230, where the relative luminous output would be around 1.05, the controller 140 would adjust the relative power-source output to be around 0.95 to achieve proper current intensity augmentation of LED brightness. The goal of the present invention is a continuous relative luminous output always at or about 1.0.

It should be apparent that the foregoing relates only to the preferred embodiments of the present application and that numerous changes and modifications may be made herein by one of ordinary skill in the art without departing from the general spirit and scope of the invention as defined by the following claims and the equivalents thereof.

I claim:

1. A system for powering an array of LEDs, comprising:

an array containing one or more light emitted diodes;

a power source connected to the LED array wherein the power source provides drive current to the LED array; and a timer connected to a controller wherein the timer logs the on-time of the LED array and communicates the LED array on-time data to the controller, wherein controller is connected to the power source and automatically adjusts the intensity of the drive current provided to the LED array based on the on-time data received from the timer to achieve a resultant relative luminous output approximately equal to the initial relative luminous output.

2. The system of claim 1, wherein the power source provides current to the LED array using a pulse width modulation scheme.

3. The system of claim 1, wherein the power source is either supplying alternating current power supply voltage or direct current power supply voltage.

4. The system of claim 1, wherein the power source is mounted on a flexible printed circuit board.

5. The system of claim 1, wherein the array of light emitting diodes comprises of one or more light emitted diodes serially connected.

6. The system of claim 1, wherein the luminous output is used to illuminate products contained in a product dispenser.

7. The system of claim 1, wherein the controller logs operating temperature data, and wherein the controller automatically adjusts the intensity of the drive current provided to the LED array based at least in part on the on-time data received from the timer and the received operating temperature data such that the resultant relative luminous output is approximately equal to the initial relative luminous output.

8. A system for powering an array of LEDs, comprising:

an array containing one or more light emitted diodes, wherein the array of light emitting diodes comprises of one or more light emitted diodes serially connected;

a power source connected to the LED array wherein the power source provides drive current to the LED array, wherein the power source provides current to the LED array using a pulse width modulation scheme, and wherein the power source is either supplying alternating current power supply voltage or direct current power supply voltage; and a timer connected to a controller wherein the timer logs the on-time of the LED array and communicates the LED array on-time data to the controller, wherein controller is connected to the power source and automatically adjusts the intensity of the drive current provided to the LED array based on the on-time data received from the timer to achieve a resultant relative luminous output approximately equal to the initial relative luminous output.

9. The system of claim 8, wherein the power source is mounted on a flexible printed circuit board.

10. The system of claim 8, wherein the luminous output is used to illuminate products contained in a product dispenser.

11. The system of claim 8, wherein the controller logs operating temperature data, and wherein the controller automatically adjusts the intensity of the drive current provided to the LED array based at least in part on the on-time data received from the timer and the received operating temperature data such that the resultant relative luminous output is approximately equal to the initial relative luminous output.

* * * * *